US010932559B2

(12) United States Patent
Hill

(10) Patent No.: US 10,932,559 B2
(45) Date of Patent: Mar. 2, 2021

(54) TELESCOPING COUNTERTOP SUPPORT BRACKET ASSEMBLY

(71) Applicant: Oz-Post International, LLC, Richardson, TX (US)

(72) Inventor: Ian A. Hill, Plano, TX (US)

(73) Assignee: Oz-Post International, LLC, Richardson, TX (US)

( * ) Notice: Subject to any disclaimer, the term of this patent is extended or adjusted under 35 U.S.C. 154(b) by 0 days.

(21) Appl. No.: 16/255,703

(22) Filed: Jan. 23, 2019

(65) Prior Publication Data

US 2020/0229589 A1 Jul. 23, 2020

(51) Int. Cl.
*A47B 13/00* (2006.01)
*A47B 33/00* (2006.01)

(52) U.S. Cl.
CPC ..... *A47B 13/003* (2013.01); *A47B 33/00* (2013.01)

(58) Field of Classification Search
CPC ..... A47B 13/003; A47B 33/00; A47B 77/022; A47B 2077/025; A47B 96/061; A47B 96/065; A47B 96/07; E04G 25/06; E04G 25/061; E04F 25/065; E04F 25/066; E04F 25/068; E04F 25/08
See application file for complete search history.

(56) References Cited

U.S. PATENT DOCUMENTS 224,863 A * 2/1880 Blessing ..... A47B 96/061 248/241
671,486 A * 4/1901 Lauman ..... A45C 1/12 232/6
683,248 A * 9/1901 Chase ..... A47G 1/1686 248/307
4,684,097 A * 8/1987 Cox ..... E04B 1/34336 248/354.3
4,720,069 A * 1/1988 Bessinger ..... A47B 96/061 211/90.01
5,806,822 A * 9/1998 Schulz ..... A61B 90/50 211/70.6
6,519,791 B2 * 2/2003 Randolph ..... E03C 1/021 4/695
8,544,805 B2 * 10/2013 Virgin ..... A47G 1/1606 248/222.11
8,955,288 B1 2/2015 Snyder
(Continued)

OTHER PUBLICATIONS

Definition of the term "flush" taken from www.merrriam-webster.com/dictionary.*

(Continued)

*Primary Examiner* — Christopher Garft
(74) *Attorney, Agent, or Firm* — Foley & Lardner LLP

(57) ABSTRACT

A telescoping countertop support bracket assembly includes a channel member that defines a plurality of through holes through a lateral wall of the channel member. Each of the through holes is configured to receive a fastener; the channel member defines a support bar receiving portion and an accessory bar receiving portion. A support bar is received by the channel member, and it is telescopically adjustable within the channel member. A countertop contact surface is supported by the support bar, and the fasteners secure the support bar within the channel member at an adjustable support length.

16 Claims, 9 Drawing Sheets

(56) References Cited

U.S. PATENT DOCUMENTS

| | | | | |
|---|---|---|---|---|
| 2012/0138761 | A1* | 6/2012 | Messinger | A47B 96/028<br>248/226.11 |
| 2016/0223171 | A1* | 8/2016 | Gibbons | F16B 9/05 |

OTHER PUBLICATIONS

Definition of the term "surface" taken from www.merrriam-webster.com/dictionary.*

The Original Granite Bracket, "Countertop Support Brackets Catalog", https://cdn.shopify.com/s/files/1/0870/0656/files/The_Original_Granite_Bracket_Countertop_Catlaog_and_Shelf_Bracket_Catalog.pdf, Date Accessed: Jan. 23, 2019, 16 pages.

* cited by examiner

TELESCOPING COUNTERTOP SUPPORT BRACKET ASSEMBLY

BACKGROUND OF THE INVENTION

Technical Field of the Invention

The present invention relates generally to support brackets for countertops or other level surfaces, such as shelves, associated with residential and commercial construction.

Description of Related Art

Countertops are important features in residential construction. In certain new residential construction and remodels, homeowners want granite, quartz, or other sturdy and solid material for their countertops and other structure supported surfaces. Granite and these other materials are heavy, can be brittle, and are sometimes seamed together to form larger surfaces or creative shapes. The installation of such surface materials must be supported by a well-built and sturdy support structure. The support structure may be a cabinet frame, a wall stud, a pony wall, an island feature, and the like. The combination of support structures and countertop lengths are numerous. It is also desirable to have deep overhangs and floating surfaces that provide clearance for comfortable seating, and in certain projects, wheelchair accessibility. Countertops are also installed at various heights to for different height bar stools, for example.

Adjustability and flexibility is often desirable in construction projects. A builder typically purchases a desired single-piece countertop support bracket that is suitable for the particular length of countertop and support structure to which the bracket will be mounted. Countertops are typically one of the final building products installed in a construction project, so it is not uncommon for a contractor to arrive on a job site and discover that other trades have changed certain elements from the original written plan. In these situations, the single-piece brackets that were specified for the particular countertops may need to be modified to work properly with the cabinets and other support structures as actually constructed. Such modifications are common with certain building projects, such as remodels, where in-process changes are common. Even small deviations from the original plan can cause specified single-piece brackets to be unsuitable for the project.

SUMMARY

In accordance with an embodiment, a telescoping countertop support bracket assembly includes a channel member that defines a plurality of through holes through a lateral wall of the channel member. Each of the through holes is configured to receive a fastener; the channel member defines a support bar receiving portion and an accessory bar receiving portion. A support bar is received by the channel member, and it is telescopically adjustable within the channel member. A countertop contact surface is supported by the support bar, and the fasteners secure the support bar within the channel member at an adjustable support length.

According to an alternate embodiment, the telescoping countertop support bracket assembly is modular in that it supports multiple mounting accessories. The mounting accessories may have any of a parallel configuration, an L-shaped configuration, a T-shaped configuration, or a side-mount configuration.

According to a further embodiment, a method of supporting a countertop includes sliding a support bar within a channel member to adjust a support length of a telescoping countertop support bracket assembly.

Technical advantages of a telescoping countertop support bracket assembly include a bracket assembly that may be secured in multiple support lengths to support multiple lengths and weights of a countertop. Further technical advantages include length-adjustable and modular countertop support bracket assemblies that allow adjustability and flexibility at a job site for a variety of support structures to which the bracket assembly may be mounted. The telescoping countertop support bracket assembly may represent a considerable improvement over single-piece mounting brackets because far fewer parts need to be fabricated and stocked to accommodate a variety of different countertop lengths and weights and mounting support structures. Those skilled in the art may recognize additional technical advantages according to the teachings of the present disclosure.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 1:
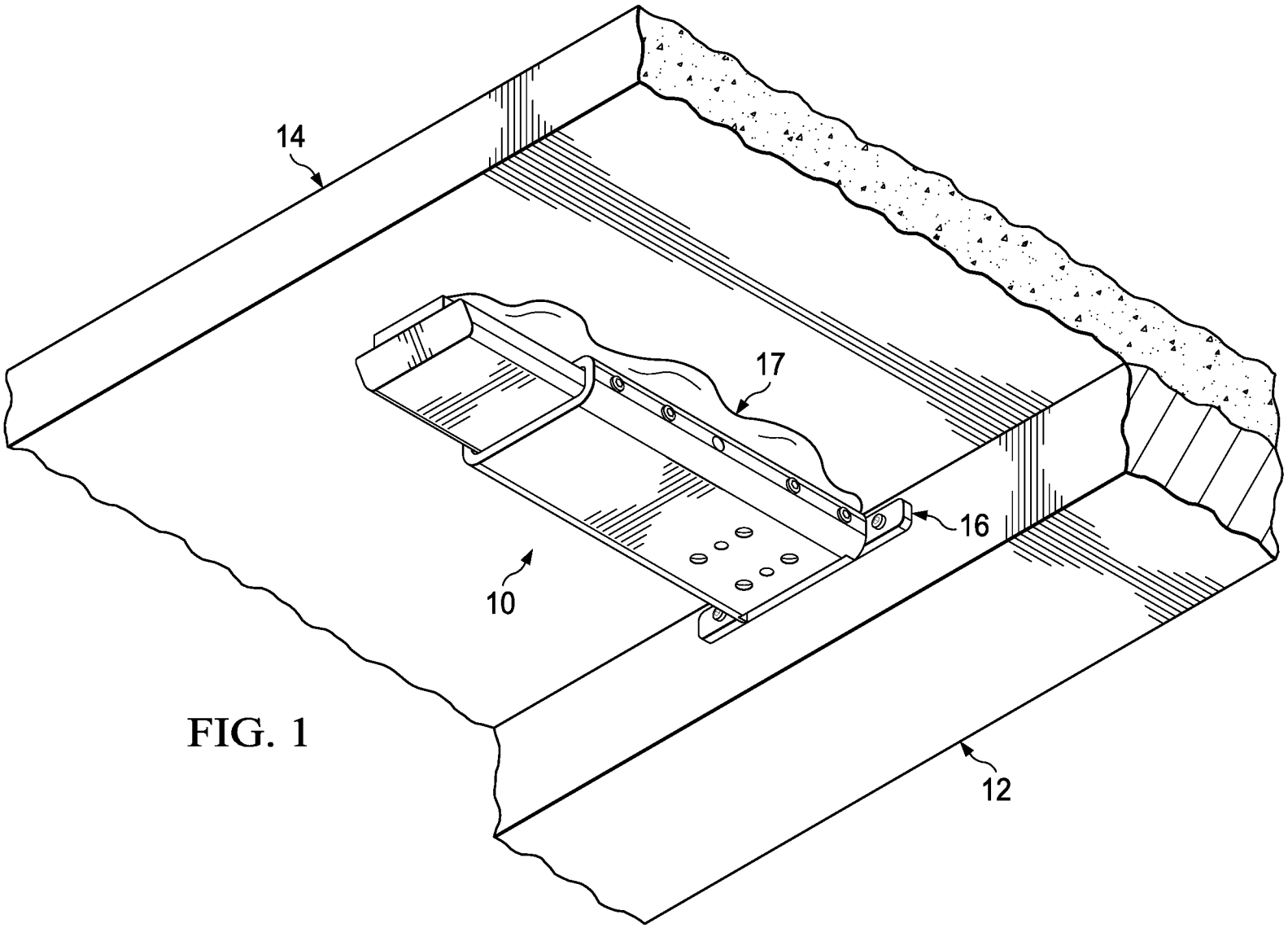
FIG. 1 is an environmental, isometric view of a telescoping countertop support bracket assembly according to an embodiment of the present disclosure.

Reference is made to FIG. 1 which shows an isometric, environmental view of a countertop support bracket assembly 10. The bracket assembly 10 is configured to attach to a support structure 12, which may be any suitable structure that can support the weight of a countertop 14. For example, the support structure 12 may be a wall stud, a cabinet frame, a pony wall, a brick wall, a concrete wall, or other structure suitable to support the load of the countertop 14 and the bracket assemblies 10. The bracket assembly 10 is modular and can be used with multiple mounting accessories, for example the parallel mounting accessory 16. As discussed further below, the mounting accessories facilitate mounting the countertop 14 in a variety of different configurations. The countertop 14 may be made from any suitable material, for example a substantially heavy and sturdy material such as granite.

An adhesive 17 is applied to an upper surface of the countertop support bracket assembly 10 and the countertop 14 is adhered to the support bracket assembly 10. A support length of the support bracket assembly 10 is adjustable to allow one bracket assembly 10 to support countertops of different sizes and weights. The countertop bracket assembly 10 is shown in an extended position such that its extended support length is approximately seven inches. The bracket assembly 10 can be retracted approximately one inch. The countertop support bracket 10 represents an improvement over conventional single-piece brackets because it is length adjustable and modular. The length adjustability allows the bracket assembly to support countertops of different sizes and weights. The modular characteristic allows the bracket assembly 10 to be used in a variety of different mounting configurations with a variety of different mounting accessories. A supplier of the bracket assembly 10 may reduce its inventory of single-piece countertop support brackets from approximately 100 SKUs to approximately 10 SKUs and maintain the flexibility to support different length countertops and different mounting configurations.

Figure 2A:
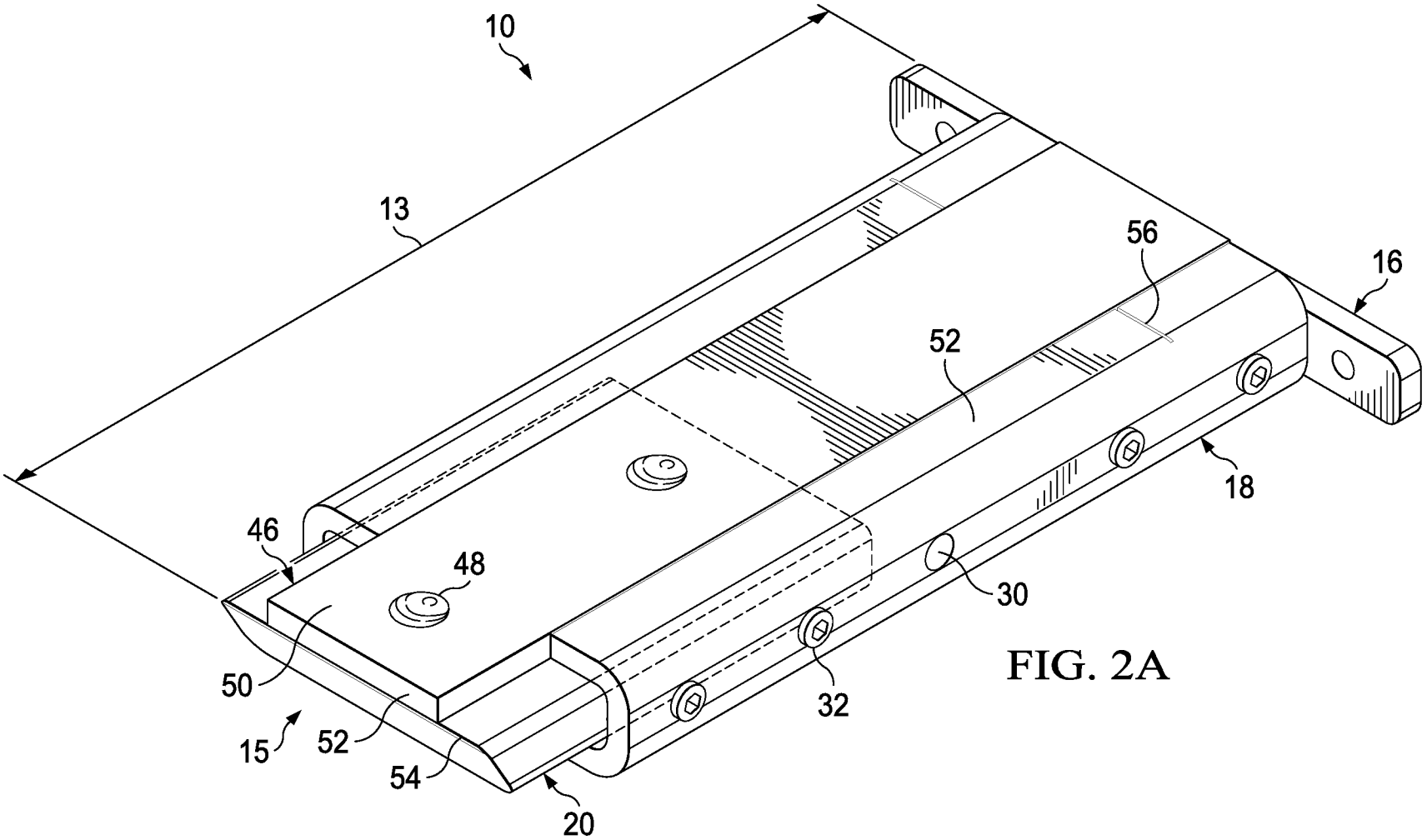
FIG. 2A is an isometric view of the telescoping countertop support bracket assembly shown in a retracted position.
Figure 2B:
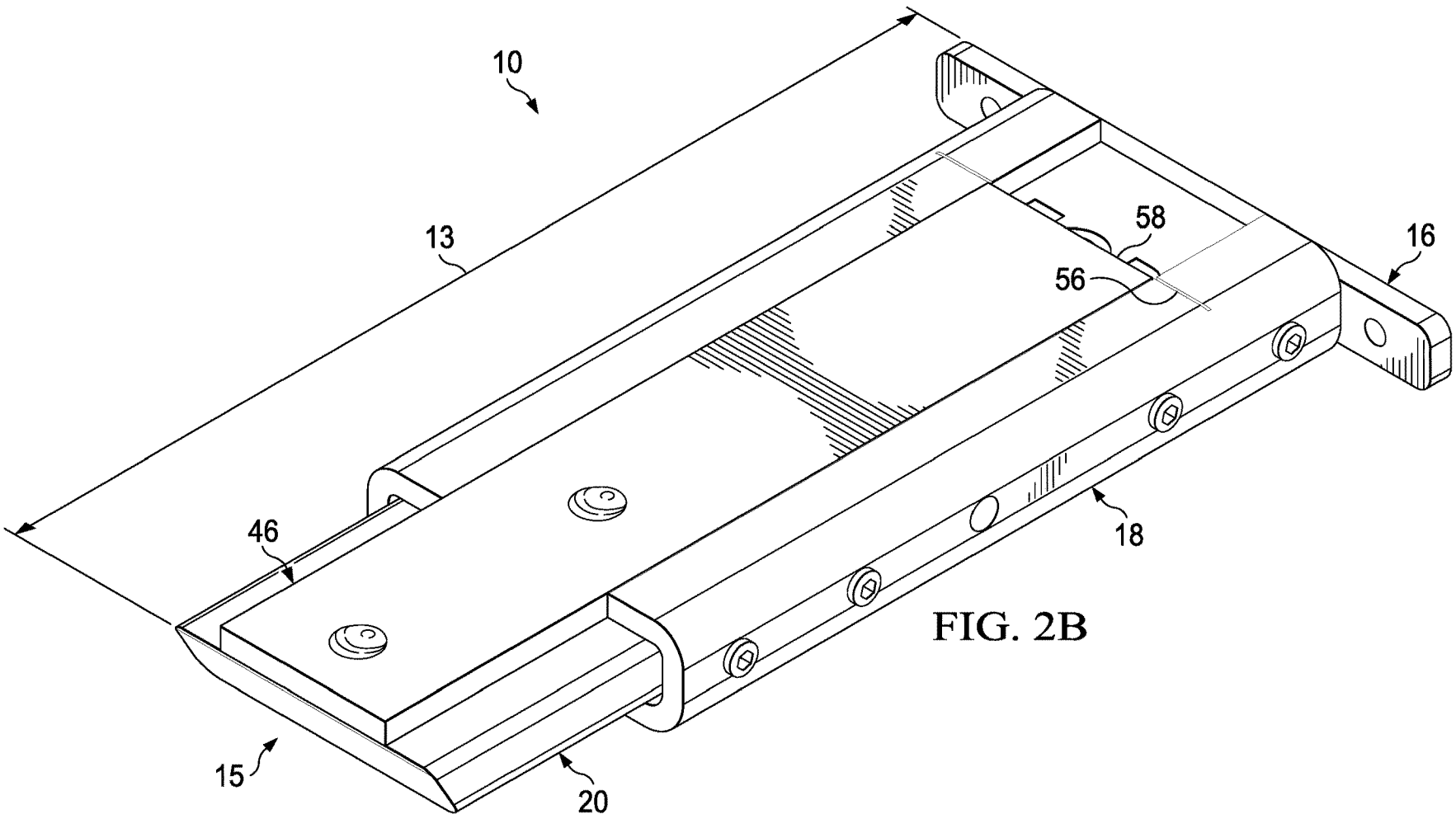
FIG. 2B is an isometric view of the telescoping countertop support bracket assembly shown in an extended position.
Figure 2C:
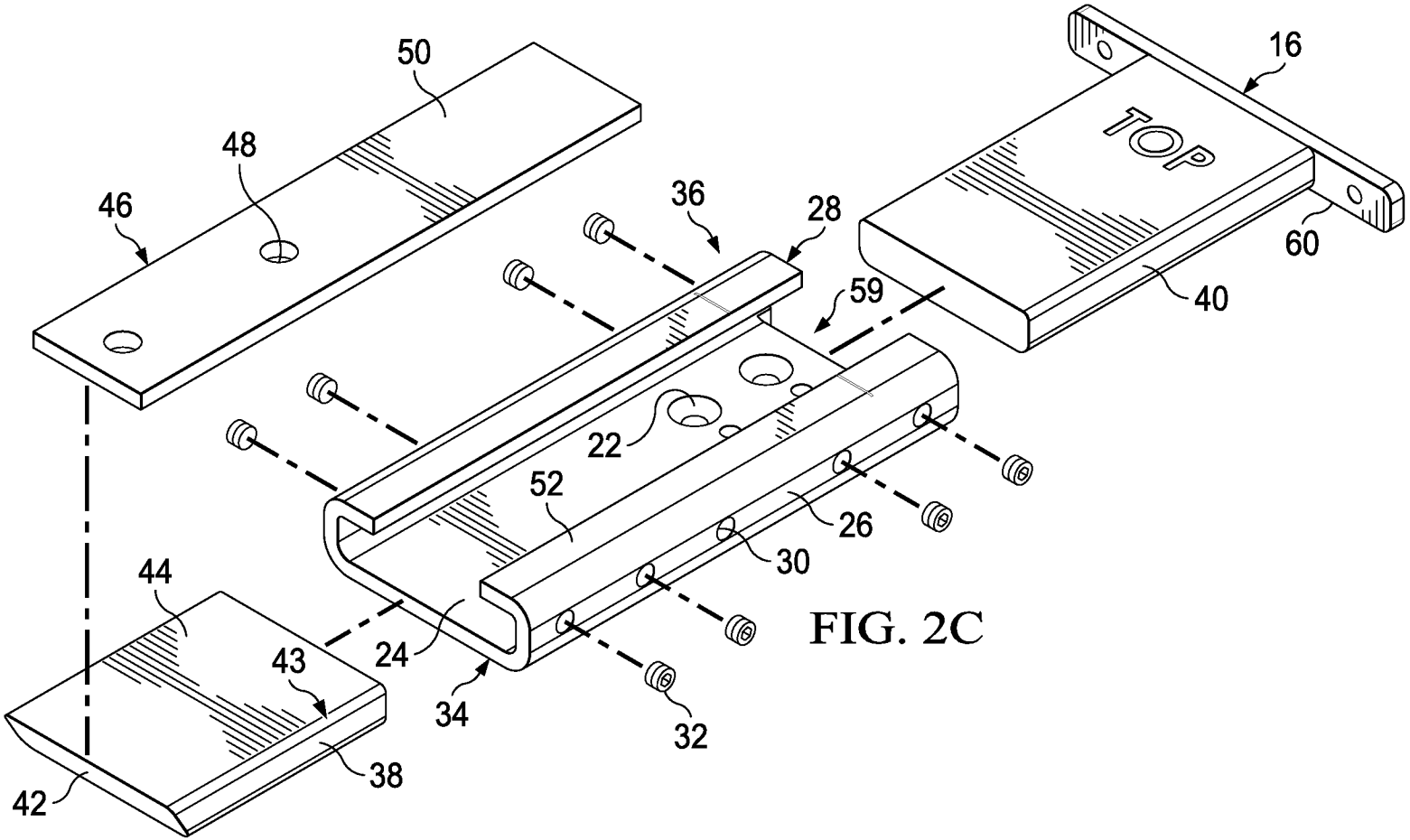
FIG. 2C is and exploded, isometric view of the telescoping countertop support bracket assembly.
Figure 8:
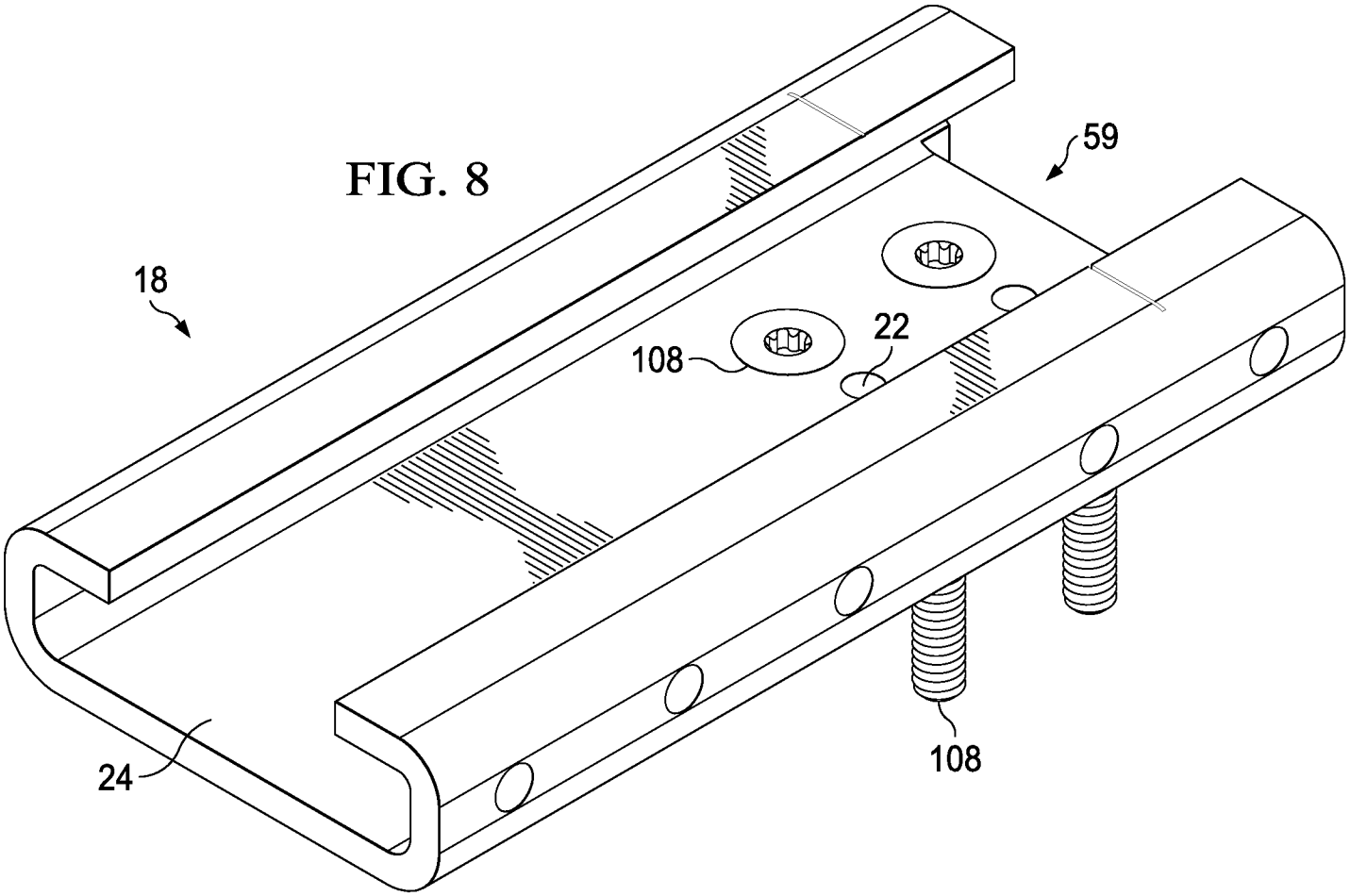
FIG. 8 is an isometric view of a channel member of a telescoping countertop support bracket assembly according to an embodiment of the present disclosure.

Reference is made to FIGS. 2A-2C. FIG. 2A is an isometric view of the countertop support bracket assembly 10 with a telescoping assembly 15 in a retracted position; FIG. 2B is an isometric view of the countertop support bracket 10 with the telescoping assembly 15 in an extended position; FIG. 2C is an exploded, isometric view of an embodiment of the countertop bracket assembly 10. The countertop support bracket assembly 10 includes a channel member 18 and a telescoping assembly 15 that is received by the channel member 18 at a first end. The telescoping assembly 15 includes a support bar 20 and a countertop contact bar 46. At a second end of the channel member 18 opposite the first end, a portion of the mounting accessory 16 is received. Alternatively, the channel member 18 may be attached directly to the support structure 12, as discussed with reference to FIG. 8. As shown in FIGS. 2C and 8, channel member mounting holes 22 facilitate direct mounting of the channel member 18 to the support structure 12. The channel member mounting holes 22 may receive fasteners, such as screws or bolts, that are then screwed to the support structure 12.

The channel member 18 is generally c-shaped and includes a floor wall 24, a pair of opposed lateral walls 26, and a pair of spaced-apart upper walls 28. The channel member 18 may be formed of a metal, such as steel, for example ASTM A36 steel, that is roll formed into the c-shape. According to one embodiment, the channel member 18 is steel with a thickness of approximately 3/16 inches, but may be thinner for lighter countertops 14, or may be thicker for heavier countertops 14. For example, the thickness of the steel of the channel member 18 may be in a range of 0.1 to 0.5 inches. The roll forming may create a rounded transition at the junction of the upper wall 28 and the respective lateral wall 26 and/or at the transition of the floor wall 24 to the respective lateral walls 26.

The channel member 18 has a support bar receiving portion 34 and a mounting accessory receiving portion 36 disposed opposite the support bar receiving portion 34. As shown in FIG. 2A, the support bar receiving portion 34 of the channel member 18 receives at least a portion of the support bar 20. And the mounting accessory receiving portion 36 receives at least a portion of the mounting accessory 16.

A plurality of holes 30 are formed through each of the lateral walls 26. According to certain embodiments, the through holes 30 may include threads configured to engage corresponding threads of a set screw 32. The set screws 32 threaded into the through holes 30 impinge on a lateral surface 38 of the support bar 20, and thereby secure the support bar 20 from unintentionally sliding forward and/or backward in the channel member 18. Of course, loosening or removing the set screws 32 allows the support bar 20 to be extended, retracted, or replaced with a different support bar in the channel member 18 to adjust the support length 13 of the bracket assembly 10. Similarly, the set screws 32 disposed in the mounting accessory receiving portion 36 are threaded into the through holes 30 and impinge on a surface of a mounting accessory bar portion 40 of the mounting accessory 16 to secure the mounting accessory 16 from sliding within the channel member 18. Loosening or removal of the set screws 32 allow the mounting accessory 16 to be removed and a different mounting accessory (see FIGS. 4-7) may be inserted into the channel member 18 and subsequently secured by the set screws 32.

According to an alternate embodiment, the threads of the through holes 30 may be omitted, and the channel member 18 may include threaded holes configured to receive a threaded fastener. The through holes in the channel member 18 may be disposed at about one inch apart along the length of the channel member 18. In yet a further alternative, the threads of the holes in the channel member 18 may be omitted. A threaded fastener may be received through the through holes 30 in a first lateral wall 26 of the channel member 18, and through a through hole in the support bar 20, and through the opposite lateral wall 26 of the channel member 18, and then receive a female threaded fastener, such as a nut to secure the support bar 20 within the channel member 18. According to a further alternate embodiment, the through holes 30 may be omitted and the support bar 20 may be allowed to slide freely within the channel member 18. Once the adhesive 17 is applied to the assembly 10 and the countertop 14 is secured to the assembly 10 by the adhesive 17, the support bar 20 will be prevented from moving back and forth within the channel member 18.

The support bar 20 may be a solid metal bar that is sized to be received between and constrained by the floor wall 24 and the upper wall 28 of channel member 18. According to one embodiment, the support bar 20 may be machined or otherwise formed out of ASTM A36 steel. An end surface 42 of the support bar 20 may be angled to increase clearance for knees underneath the countertop 14. Alternatively, the end surface 42 may be square, as opposed to angled. An upper surface 44 of the support bar 20 is configured to contact the upper wall 28 of the channel member 18, and the channel member 18 opposes a moment of a force on the support bar 20 created by the weight of the countertop 14. A chamfer 43 may be formed at a junction of the lateral surface 38 and the upper surface 44. Alternatively, the chamfer 43 may be replaced with a rounded surface or may be left as a square edge. The chamfer 43 or a rounded surface may facilitate the support bar 20 being received by the channel member 18.

According to one embodiment, the support bracket assembly 10 includes the countertop contact bar 46 that is separate from the support bar 20. The countertop contact bar 46 may be a sheet of metal, such as ASTM A36 steel, that is secured to the upper surface 44 of the support bar 20. The countertop contact bar 46 may be thin relative to the support bar 20 and may have a length greater than the support bar 20. The countertop contact bar 46 may have one or more through holes 48. The through holes 48 may be welding holes that allow the countertop contact bar 46 to be welded from above to the upper surface 44 of the support bar 20. Other methods of securing the countertop contact bar 46 to the support bar 20 are contemplated by this disclosure, including securing with fasteners such as screws received in a threaded hole in the support bar or adhesive.

As shown in FIG. 2A, the countertop contact bar 46 is welded or otherwise secured to the support bar 20 such that a distal end 52 of the countertop contact bar 46 is even with an edge 54 formed at the junction of the end surface 42 and the upper surface 44 of the support bar 20. The support bar 20 is received by the channel member 18. When the support bar 20 is inserted into the channel member 18, the countertop contact bar 46 is disposed between the pair of upper walls 28. A countertop contact surface 50 of the countertop contact bar 46 is disposed flush with an upper surface 52 of the upper walls 28 of the channel member 18. The countertop contact bar 46 extends to the end of the channel member 18 when the assembly 10 is in the retracted position shown in FIG. 2A. The countertop contact bar 46 extends over the mounting accessory bar portion 40.

The countertop contact surface 50 together with the upper surface 52 of the channel member 18 form a surface that contacts the underside of the countertop 14. The adhesive 17, for example silicone or other general construction adhesive that is known in the art, may be applied to these surfaces and the countertop 14 is thereby secured to the bracket assembly 10.

FIG. 2B shows the telescoping assembly 15 of the bracket assembly 10 in an extended position. The support bar 20 together with the countertop contact bar 46 is extended an additional distance from the channel member 18. According to one embodiment, the additional distance may be approximately one inch. A scribe line 56 may be etched, marked, or otherwise formed in the upper surface 52 of the upper wall 28 of the channel member 18. The scribe line 56 may be disposed to align with a proximal edge 58 of the countertop contact bar 46. With reference to FIG. 2C, in certain embodiments, a cutout 59 is formed in the floor wall 24. The floor wall cutout 59 may receive a fastener bar portion of a mounting accessory, as described in more detail below.

The countertop bracket assembly 10 may have any suitable length. Longer bracket assemblies may support further extension of the support bar 20. For example, a bracket assembly 10 may have a channel member 18 with a length of 36". The telescoping assembly 15 may provide a support length 13 from 37 inches in the retracted position to 48" in the extended position. The support length 13 is the length of the assembly 10 that contacts the countertop 14. The support length 13 is measured from a proximal end of the channel member 18 to the distal end of the support bar 20 and/or the countertop contact bar 46. This disclosure contemplates a range of channel member lengths from seven inches to thirty-six inches. For example, a channel member 18, a support bar 20, and a countertop contact bar 46 may have the lengths set forth in the following table to provide the range of support lengths 13 shown below. All table values are in inches.

| Support Length Range | Channel Member | Support Bar | Countertop Contact Bar |
|---|---|---|---|
| 7 | 6 | 3 | 7 |
| 8-9 | 7 | 4 | 8 |

-continued

| Support Length Range | Channel Member | Support Bar | Countertop Contact Bar |
|---|---|---|---|
| 10-13 | 9 | 6 | 10 |
| 14-18 | 13 | 9 | 13 |
| 19-26 | 18 | 14 | 18 |
| 27-36 | 26 | 16 | 22 |
| 37-48 | 36 | 20 | 26 |

As discussed above, the mounting accessory 16 includes the mounting accessory bar portion 40 and a fastener bar 60 coupled to the mounting accessory bar portion 40 via welding or other similar method of joining separate metal parts, such as adhesive or mechanical fasteners. The mounting accessory bar portion 40 may be approximately four inches in length to ensure that it is securely received in the channel member 18 and supports the weight of the countertop without the channel member 18 unintentionally sliding off the mounting accessory 16. The mounting accessory 16 may have a variety of different configurations, as discussed in more detail below.

Figure 3:
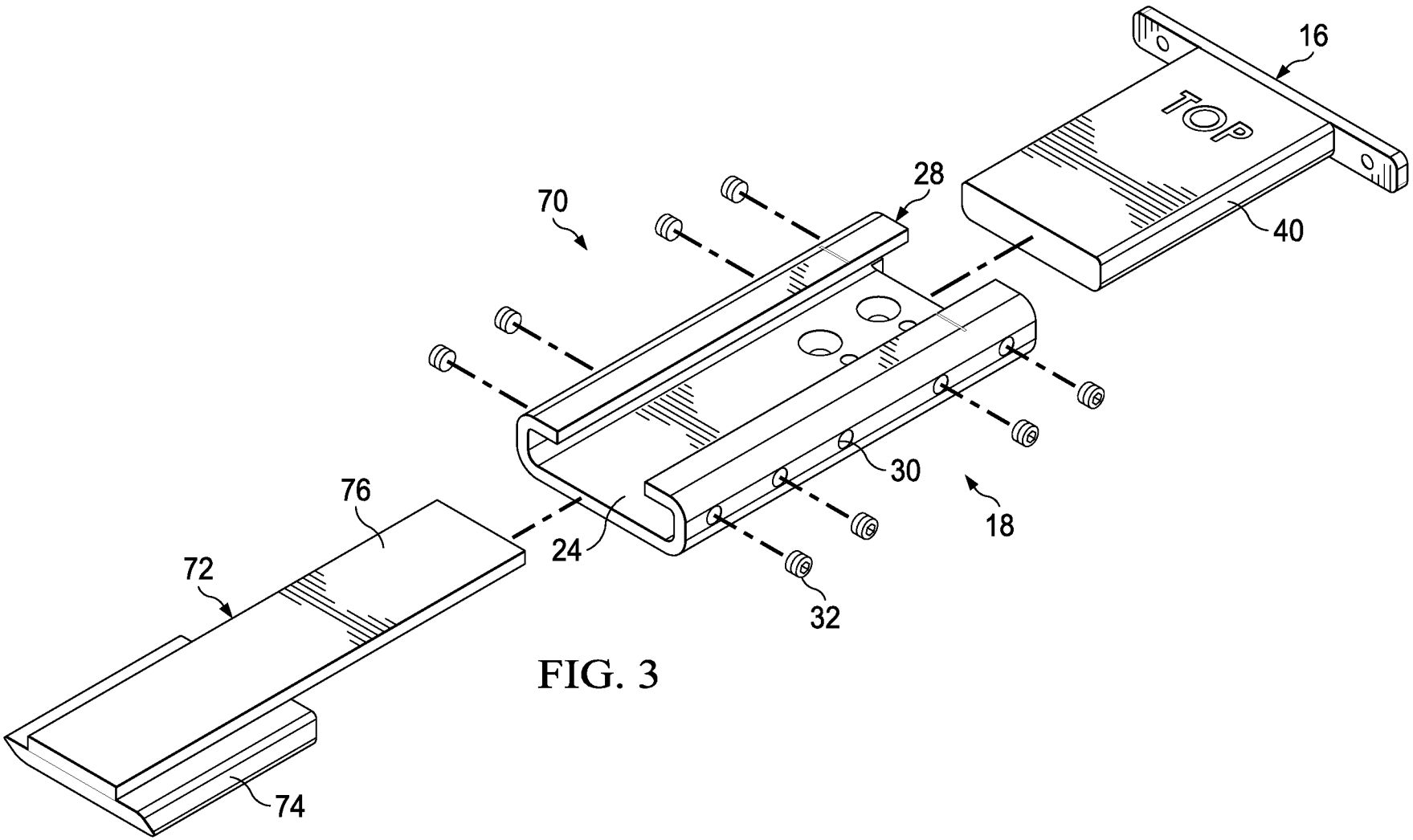
FIG. 3 is and exploded, isometric view of an alternate embodiment of the telescoping countertop support bracket assembly.

FIG. 3 shows and isometric, exploded view of an alternate embodiment of a countertop support bracket assembly 70 that includes the channel member 18, the mounting accessory 16, and a telescoping support bar 72. The telescoping support bar 72 is a unitary piece of steel, for example ASTM A36 steel. The steel is machined, cast, or otherwise formed into the telescoping support bar 72. The telescoping support bar 72 includes a channel member insertion portion 74 and a countertop contact portion 76. The channel member insertion portion 74 generally corresponds in configuration to the support bar 20, and the countertop contact portion 76 generally corresponds to the countertop contact bar 46. The insertion portion 74 is sized and shaped to be received in the channel member 18 such that the countertop contact portion 76 is disposed between the upper walls 28 of the channel member 18. A countertop contact surface 76 is flush with the upper surface 52 of the channel member 18. According to certain embodiments, the countertop contact portion 76 may be coextensive with the channel insertion portion 74. According to an alternate embodiment, some of the insertion portion 74 may be machined or otherwise removed or omitted such that the countertop contact portion 76 overhangs the insertion portion at a proximal end of the insertion portion 74, similar to the embodiment shown in FIGS. 1-2C.

Figure 4:
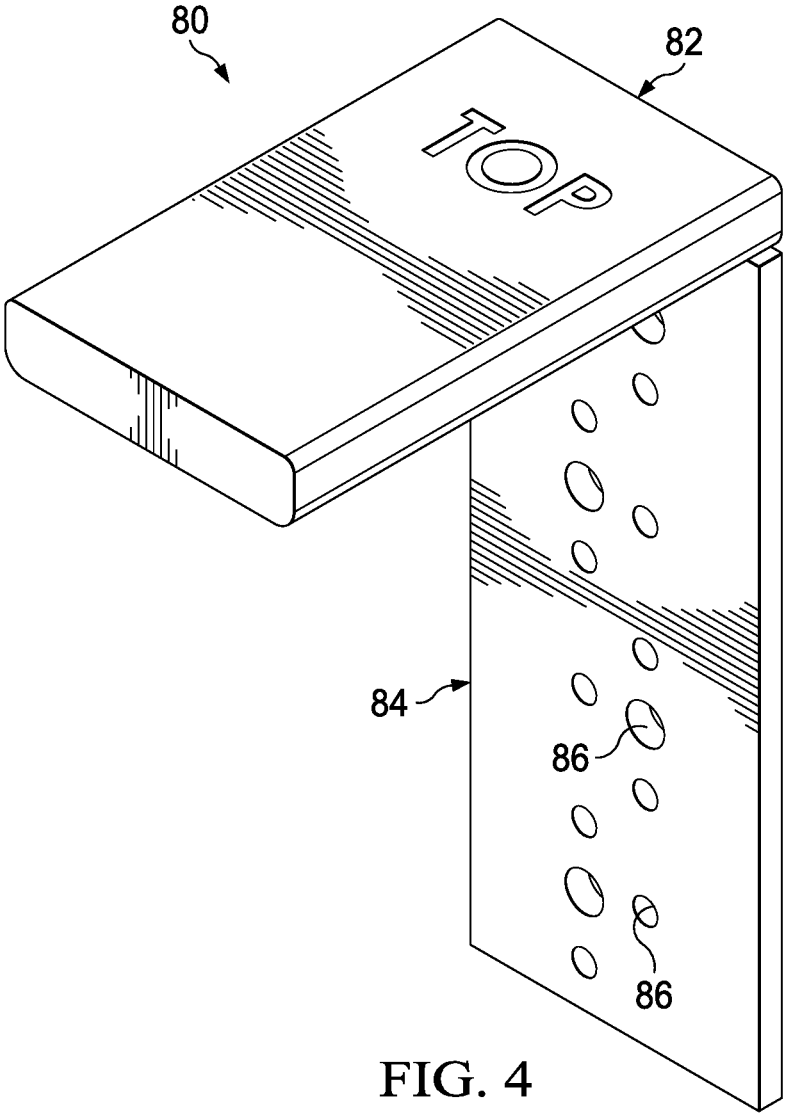
FIG. 4 is an isometric view of an embodiment of a mounting accessory for the telescoping countertop support bracket assembly.

FIG. 4 shows an isometric view of an L-shaped mounting accessory 80. The L-shaped mounting accessory 80 includes a mounting accessory bar portion 82 and a fastener bar 84 extending orthogonally from an end of the mounting accessory bar portion 82 to form an L-shape. The fastener bar 84 may be welded or otherwise secured to the bar portion 82. The fastener bar 84 includes a plurality of through holes 86 configured to receive a mechanical fastener. The through holes may have different diameters to support differently sized fasteners. According to one embodiment, a larger diameter through hole may be partially surrounded by smaller diameter through holes. Mounting hardware disclosed in U.S. Pat. No. 9,957,998 to Ian Hill, which is incorporated herein by reference, may be secured to the larger hole and the hex nut and washer portion may conceal the surrounding smaller diameter holes. The fastener bar 84 of the L-shaped mounting accessory 80 may be secured to a vertical structure and the mounting bar portion 82 is received in the channel member 18 as discussed above. The countertop support bracket assembly 10 is assembled as discussed above to support a countertop cantilevered from the vertical support structure. The fastener bar 84 may be received by the cutout 59 in the floor wall 24 of the channel member 18 (see FIG. 2C).

Figure 5:
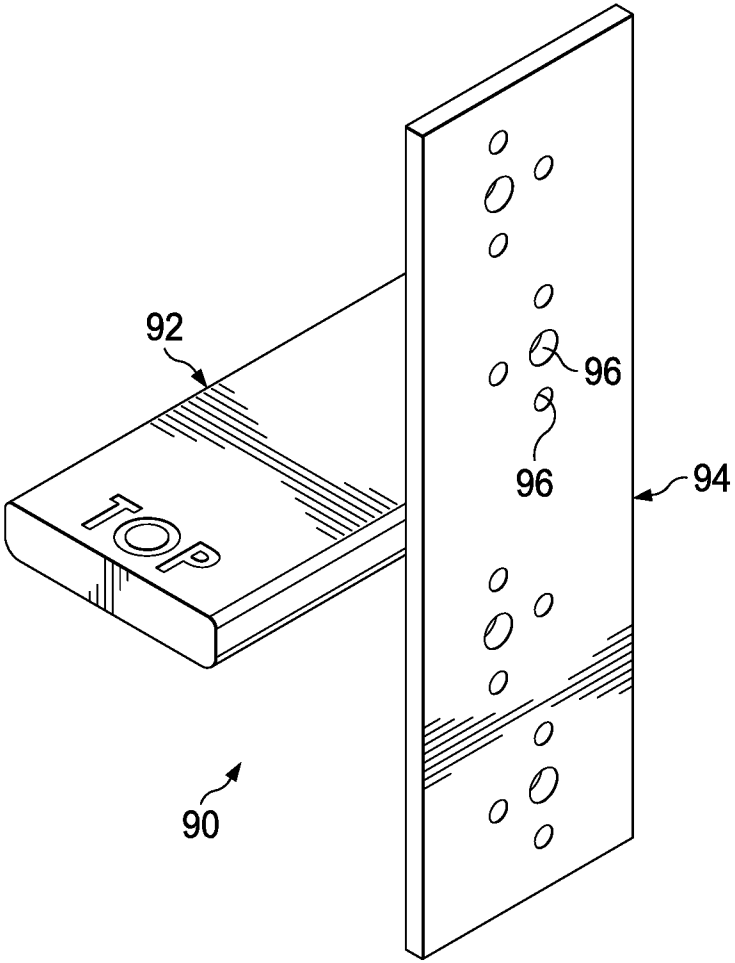
FIG. 5 is an isometric view of an alternate embodiment of a mounting accessory for the telescoping countertop support bracket assembly.

FIG. 5 is an isometric view of a side-mount mounting accessory 90. A fastener bar 94 is attached to a lateral side of the mounting bar portion 92. The mounting bar portion 92 may be generally vertically centered along a length of the fastener bar 94 such that about half a length of the fastener bar 94 extends above the mounting bar portion 92, and about half a length of the fastener bar 94 extends below the mounting bar portion 92. The fastener bar 94 may be secured to either the left side or the right lateral side of the mounting bar portion 92. The fastener bar 94 may be welded or otherwise secured to the mounting accessory bar portion 92. The fastener bar 94 includes a plurality of through holes 96 configured to receive a mechanical fastener. The fastener holes may have different sized diameters to accommodate a variety of sizes of mechanical fasteners. The mounting bar portion 92 is received within the channel member 18 and secured therein by the set screws 32. The fastener bar 94 is secured to a support structure, such as a wall stud.

Figure 6:
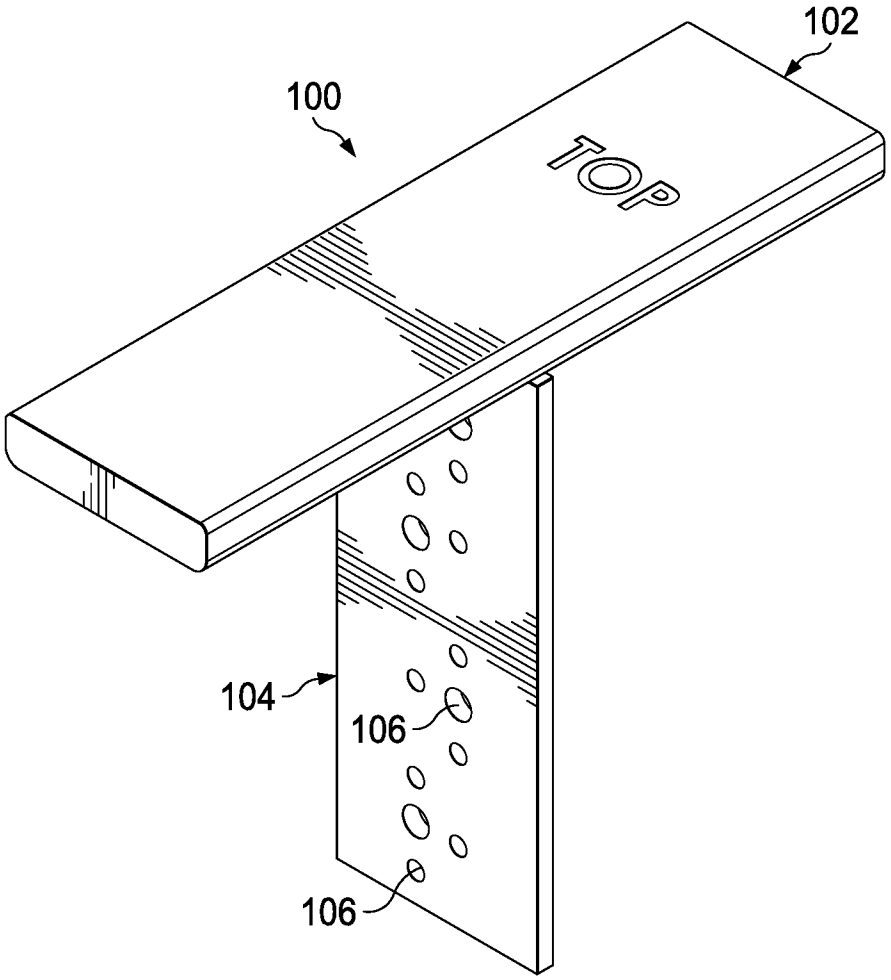
FIG. 6 is an isometric view of an alternate embodiment of a mounting accessory for the telescoping countertop support bracket assembly.

FIG. 6 is an isometric view of a T-shaped mounting accessory 100 that includes a mounting accessory bar portion 102 and a fastener bar 104 extending from the mounting accessory bar portion 102. The T-shaped mounting accessory 100 may support a countertop of an island of a kitchen or outdoor patio. The fastener bar 102 may be generally centered along a length of the mounting accessory bar portion 102 such that about half the length (about four inches) of the mounting accessory bar portion 102 extends in one direction from fastener bar 104 and about half the length (about four inches) of the mounting accessory bar portion 102 extends in an opposite direction from the fastener bar 104. The fastener bar 104 includes through holes 106, and the fastener bar 104 may be welded or otherwise secured to the mounting accessory bar portion 102.

Figure 7:
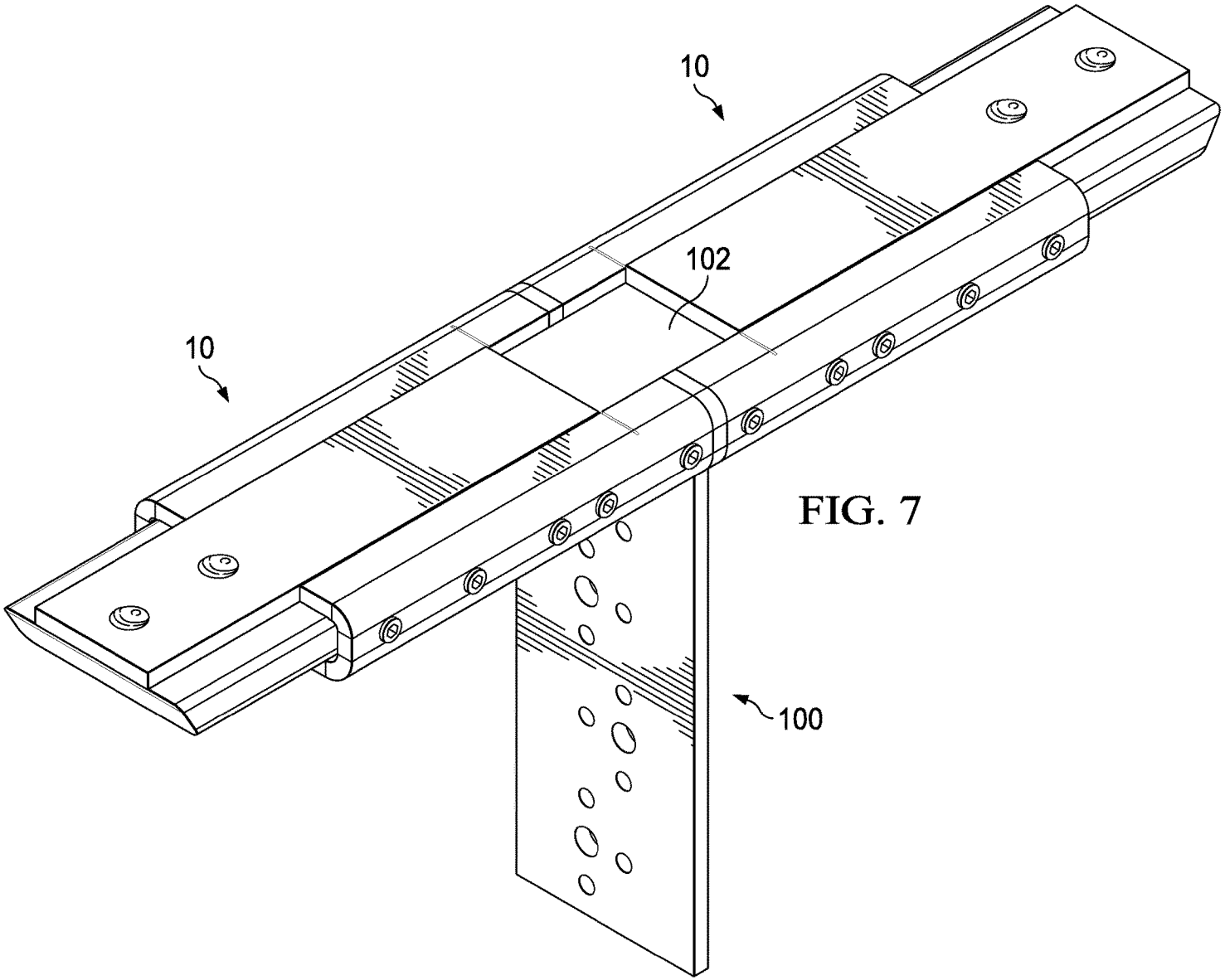
FIG. 7 is an isometric view of a pair of telescoping countertop support bracket assemblies employing the embodiment of the mounting accessory shown in FIG. 6.

FIG. 7 is an isometric view of a pair of countertop support bracket assemblies 10 employing the T-shaped mounting accessory 100. The mounting bar 102 is received partially in a first channel member 18 and partially in a second channel member 18. The fastener bar 104 is secured to a support structure and thereby supports two bracket assemblies 10 simultaneously. The two bracket assemblies 10 may be adhered to a single countertop, for example a single slab of granite.

FIG. 8 is an isometric view of the channel member 18 of the countertop support bracket assembly 10. As discussed above, through holes 22 may be formed in the floor wall 24. The through holes 22 may receive mechanical fasteners 108 to allow the channel member 18 to be directly mounted to a support structure. In this manner, the mounting accessory 16 may be omitted. The telescoping assembly 15 or telescoping bar 72 is received in the channel member 18 as discussed above, and the countertop 14 is adhered to the countertop contact surface 50 of the telescoping assembly 15 or the telescoping support bar 72.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A countertop support bracket assembly, comprising:

a channel member comprising a pair of opposed upper walls and a pair of opposed lateral walls, at least one of the pair of opposed lateral walls defining a plurality of through holes, each of the through holes being configured to receive a fastener;

a support bar received by the channel member, the support bar being telescopically adjustable within the channel member;

an uppermost surface supported by the support bar;

a mounting accessory comprising a bar portion and a fastener bar extending from the bar portion, the channel member configured to receive the bar portion, the bar portion being disposed between the pair of opposed lateral walls, the fastener bar comprising a plurality of through holes;

wherein the fasteners secure the support bar within the channel member at a support length; and wherein the uppermost surface is disposed flush with upper surfaces of the pair of opposed upper walls and together form a countertop contact surface.

2. The countertop support bracket assembly of claim 1 wherein the uppermost surface is integral to the support bar.

3. The countertop support bracket assembly of claim 1 further comprising a countertop contact bar coupled to the support bar, the countertop contact bar defining the uppermost surface.

4. The countertop support bracket assembly of claim 1 wherein the countertop contact surface extends rearwardly beyond the support bar.

5. The countertop support bracket assembly of claim 1 wherein each fastener is a set screw in threaded engagement with a respective one of the through holes.

6. The countertop support bracket assembly of claim 1 wherein the channel member further comprises a floor wall defining a second plurality of through holes configured to directly secure the channel member to a support structure.

7. The countertop support bracket assembly of claim 1 wherein the support length is in a range of 10-13 inches.

8. The countertop support bracket assembly of claim 1 wherein the support length is in a range of 37-48 inches.

9. A modular countertop support bracket, comprising:

a channel member comprising a floor wall, a pair of opposed lateral walls, and a pair of opposed upper walls, the channel member defining a first end and a second end; and a support bar received in the first end of the channel member and being slidable within the channel member to adjust a support length, the support bar supporting a support surface;

a mounting accessory comprising a bar portion and a fastener bar extending from the bar portion, the bar portion received in the second end of the channel member and disposed between the pair of opposed lateral walls, the fastener bar comprising a plurality of through holes; and wherein the support surface is disposed flush with upper surfaces of the pair of opposed upper walls and together form a countertop contact surface.

10. The modular countertop support bracket of claim 9 wherein the fastener bar extends from a center of the bar portion.

11. The modular countertop support bracket of claim 9 wherein the fastener bar extends from an end of the bar portion.

12. The modular countertop support bracket of claim 9 wherein the fastener bar is coupled to a lateral wall of the bar portion.

13. A modular countertop assembly, comprising:

a channel member comprising a floor wall, a pair of opposed lateral walls, and a pair of opposed upper walls, the channel member defining a first end and a second end;

a support bar, the first end of the channel member being configured to receive the support bar, wherein the support bar is slidable within the channel member to adjust a support length;

a mounting accessory comprising a bar portion and a fastener bar extending from the bar portion, the second end of the channel member receiving the bar portion to thereby dispose the bar portion between the pair of opposed lateral walls, the fastener bar comprising a plurality of through holes; and an upper surface supported by the support bar disposed flush with upper surfaces of the pair of opposed upper walls and together forming a countertop contact surface.

14. The modular countertop assembly of claim 13 further comprising an adhesive disposed between a countertop and the countertop contact surface.

15. The modular countertop assembly of claim 13 wherein each one of the pair of opposed lateral walls defines a plurality of through holes configured to receive a fastener.

16. The modular countertop assembly of claim 15 wherein each fastener is a set screw in threaded engagement with a respective one of the through holes.

* * * * *